US005697245A

United States Patent [19]

Maeng

[11] Patent Number: 5,697,245

[45] Date of Patent: Dec. 16, 1997

[54] APPARATUS FOR FORGE-FORMING OUTER-RING OF CONSTANT VELOCITY JOINT AND METHOD THEREOF

[76] Inventor: Hyuk Jae Maeng, 12-6 Wanggil-ri, Keomdan-myun, Gimpo-gun, Kyungki-do, Rep. of Korea

[21] Appl. No.: 615,311

[22] PCT Filed: Jul. 18, 1995

[86] PCT No.: PCT/KR95/00091

§ 371 Date: Mar. 14, 1996

§ 102(e) Date: Mar. 14, 1996

[87] PCT Pub. No.: WO96/02337

PCT Pub. Date: Feb. 1, 1996

[30] Foreign Application Priority Data

Jul. 16, 1994 [KR] Rep. of Korea ..... 94.17190

[51] Int. Cl.[6] ..... B21D 22/00

[52] U.S. Cl. ..... 72/353.4; 72/359; 72/353.6

[58] Field of Search ..... 72/344, 345, 353.4, 72/353.6, 354.2, 358, 359

[56] References Cited

U.S. PATENT DOCUMENTS

| | | | |
|---|---|---|---|
| 4,406,146 | 9/1983 | Suzuki | 72/358 |
| 5,001,920 | 3/1991 | Ishinaga et al. | 72/345 |
| 5,099,672 | 3/1992 | Steinhauser et al. | 72/345 |

*Primary Examiner*—Lowell A. Larson
*Assistant Examiner*—Rodney A. Butler
*Attorney, Agent, or Firm*—Blakely Sokoloff Taylor & Zafman

[57] ABSTRACT

An outer-ring of a constant velocity joint is fabricated by pressing an inner surface of the pre-processed outer-ring (2A) set in a lower die (3) by using a forging punch (20) in which plural punch pieces (11) each having a protrusion (111) corresponding to the ball track groove (6) are slidably coupled to plural downwardly tapered grooves (131) of a punch piece slide member (13), so that an upper periphery (9A) of the pre-processed outer-ring (2A) is contracted in line with a head shape of the forging punch (20), and ascending the forging punch.

6 Claims, 17 Drawing Sheets

APPARATUS FOR FORGE-FORMING OUTER-RING OF CONSTANT VELOCITY JOINT AND METHOD THEREOF

TECHNICAL FIELD

The present invention relates in general to an apparatus and method for forge-forming an outer-ring of a constant velocity joint, and more particularly to an apparatus for forge-forming the outer-ring of constant velocity joint capable of producing a high precision outer-ring by only a contraction of punch pieces instead of expansion and contraction, and of preventing breakage of the punch pieces by simplifying the structure of an outer-ring forging punch and a lower press, and a method thereof.

BACKGROUND ART

The constant velocity joint has dual shafts in which and inner-ring 1 and outer-ring 2 formed at its end are connected through a torque transmitting ball 3 inserted into ball grooves 5 and 6 which are formed uniformly between the inner-ring and outer-ring as shown in FIGS. 1 and 2.

A peripheral surface 7 of the inner-ring 1, an inner surface 8 of the outer-ring 2, and a ball cage 4 are formed of a spherical surface in which its center of curvature is located at the center of joint 0, and the ball groove 5 of the inner-ring 1 and the ball grove 6 of the outer-ring 2 are formed of curves which have the center of curvature on offset points A and B aparted equal distance from the center of joint 0. Therefore, since a track of ball center travelling the ball groove has the curve with the center of curvature at points A and B, the ball 3 is always directed to a plane bisecting an angle which dual shafts form, thereby maintaining the constant velocity.

To fabricate such an outer-ring of the constant velocity joint in which has the inner surface of the spherical surface and the ball groove of the curved surface, the prior art method forms the inner surface and the ball groove by cut-forming an outer-ring forming material in which both the inner surface and the ball groove are hot forged as straight.

However, since the centers of curvature of the spherical inner surface 8 and the ball groove 6 are equal each other and there shapes are complicated, it takes long time in fabricating it by milling and wastes many portions of the forming material.

Recently, many fabricating apparatuses for the constant velocity joint have been developed and used. For example, Japanese Laid-open Patent Gazette No. 57-177843 discloses a method of fabricating the outer-ring of the constant velocity joint. This method prepares a pre-formed material in which the inner surface is formed as conical shape which expands from maximum diameter portion to apature end, the ball grooves are formed on the inner surface as straight from maximum diameter portion to apature end, and small escaping grooves are formed on the spherical surface between ball grooves.

Then, the inner surface of the material is contracted from the periphery to diameter direction on a die having a conical inner surface, by using seperate type punch which plural curve forming members are mounted contractably and a protruding punch, in the state that gap between curve forming members are located in line with the escaping grooves of the material.

The above-mentioned technique has problems which are apt to break punch pieces and a punch piece guiding shaft due to vertical load in mass production and are difficult to replace the broken punch pieces for new punch pieces. Further, since the punch pieces are coupled to the punch piece guiding shaft with gap, undersirable protrusion portions are formed in the spherical inner surface of the inner-ring after forge forming.

Since the punch pieces may be shifted right and left, the precise bisect angle of ball track grooves and the distance therebetween can not be guaranteed in the formed outer-ring.

To solve such problems of the above technique, another outer-ring forging apparatus and method have been proposed at Korean Patent Gazette No. 91-3896. This technique forms spherical inner suface and ball track grooves by forging a material in which semicircled track grooves and circular surface are formed previously.

However, according to this technique, the outer-ring is fabricated by pressing, expansion and contraction of punch pieces.

Thus, the punch for executing the expansion and contraction of the punch pieces has the structure which does not guarantee the durability in mass production as follows: the structure of a supporting ring nut to couple between the punch holder and punch pieces, elastical ring for contraction of the punch pieces, and expanding structure of punch pieces by a mandrel. In addition, since die hole of the lower die is used as drop passage of the formed outer-ring, the lower die does not function as sufficient support when forge forming the outer-ring.

DISCLOSURE OF INVENTION

It is an object of the invention to provide a forge-forming apparatus capable of producing a high precision outer-ring of constant velocity joint and preventing breakage of the punch pieces by simplifying a structure of an outer-ring forging punch and a lower die and guaranteeing smooth forming operation of the punch piece assembly.

It is an another object of the invention to provide a forge-forming method capable of producing a high precision outer-ring by pressing and contraction of punch pieces.

According to a first feature of the present invention, there is provided an outer-ring forge-forming apparatus of a constant velocity joint having a spherical inner surface and a plurality of curved ball track grooves comprising:

- a plurality of punch pieces, each having a protrusion which is, at the lower portion, formed of a hemisphere shape corresponding to the curved ball track groove, and an angled protrusion at its upper end;
- a punch piece slide member having a plurality of downwardly tapered grooves in which said plurality of punch pieces are coupled slidably;
- an outer tube having, at its lower end, an inwardly extending portion which supports said punch piece slide member and forms a sliding guide in cooperation with said tapered grooves of the punch piece slide member;
- a plurality of resilient member assemblies formed in the inwardly extending portion for supporting resiliently said plurality of punch pieces; and
- a lower die having an inner surface of the same shape as an exterior surface of the outer-ring.

According to a second feature of the invention, there is provided an outer-ring forging punch of a constant velocity joint comprising:

- a plurality of punch pieces, each having a hemispher-shape protrusion at the lower portion and an inward protrusion at the upper portion;

a punch piece slide member having a plurality of downwardly tapered grooves, said each tapered groove having a deep groove corresponding to the inward protrusion;

a plurality of resilient member, each inserted between the deep groove and the inward protrusion for urging the punch pieces in the upward direction;

a stem coupled to a through-hole of the slide member and having a spherical protrusion at its lower end; and an outer tube for accomodating and supporting the slide member in which the punch pieces and the stem are coupled and guiding sliding of the punch pieces in an up and down movement.

According to a third feature of the invention, there is provided an outer-ring forging punch of a constant velocity joint comprising:

a plurality of punch pieces, each having a protrusion which is, at the lower portion, formed of a hemispher shape corresponding to a ball track groove the outer-ring and an angled protrusion at its upper end;

a punch piece slide member having a plurality of downwardly tapered grooves in which said plurality of punch pieces are coupled slidably;

a stem coupled to a central through-hole of the slide member and having a spherical protrusion at its lower end;

an outer tube for accomodating and supporting the slide member in which the punch pieces 16 and the stem are coupled, and guiding the punch pieces in cooperation with the slide member; and means inserted between the angled protrusion of the punch pieces and the outer tube for returning the puch pieces.

According to a fourth feature of the invention, there is provided a method for forge-forming an outer-ring of a constant velocity joint having a spherical inner surface and a plurality of curved ball track grooves, comprising the steps of:

preparing a pre-processed outer-ring in which its spherical inner surface and curved ball track grooves expand as straight from a maximum diameter portion to an apature end;

setting the pre-processed outer-ring in a groove of a lower die;

pressing an inner surface of the pre-processed outer-ring by using a forging punch in which a plurality of punch pieces each having a protrusion corresponding to the ball track groove are slidably coupled to a plurality of downwardly tapered grooves of a punch piece slide member, so that an upper periphery of the pre-processed outer-ring is contracted in line with a head shape of the forging punch;

vertically ascending the forging punch so that said plurality of punch pieces slides along the tapered grooves of the slide member until the lower portions of the punch pieces are separated from the inner surface of the forged outer-ring; and returning said plurality of punch pieces separated from the forged outer-ring by means of a restorating force of a plurality of corresponding resilient member in accordance with further ascent of the forging punch.

The forge-forming punch further comprises a stem which has a spherical protrusion and is coupled to a through-hole formed at the center of the slide member.

BEST MODE FOR CARRYING OUT THE INVENTION

Figure 1:
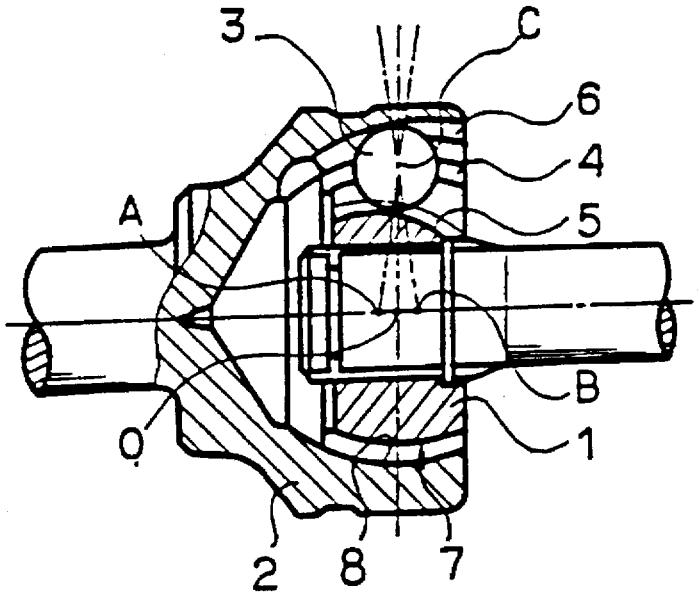
FIG. 1 is a longitudinal and sectional side view of a constant velocity joint to which the present invention is applied.
Figure 2:
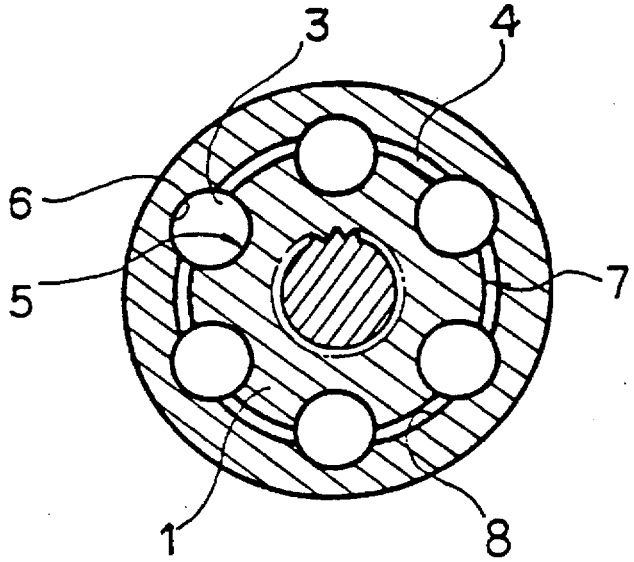
FIG. 2 is a cross-sectional front view in the center of the constant velocity joint as shown in FIG. 1.

Referring to FIGS. 3 to 6, there is shown an outer-ring forging punch 20 according to a first embodiment of the present invention. In this embodiment, a reference numeral 11 designates six punch pieces, each having a protrusion 111 which is located at the lower portion and is formed of a hemisphere shape corresponding to the curved ball track groove 6 of the outer-ring 2, and an angled protrusion 113 at its upper end. A numeral 13 designates a punch piece slide member having six downwardly tapered grooves 131 in which six punch pieces 11 are coupled slidably and a numeral 15 designates a stem 15 which is inserted into a through-hole 133 formed in the center of the punch piece slide member 13, the stem having a spherical protrusion 151 at its lower end. A numeral 17 designates an outer tube having an inwardly extending portion 171 at the lower end, so that the upper portion of the punch piece slide member 13 is accommodated inside and the lower portion of the punch piece slide member 13 is protruded outside and a numeral 19 designates six resilient member assemblies formed in the inwardly extending portion 171 of the outer tube 17.

The outer-ring forging punch 20 is fixed to a hard plate 21 by a coupling nut 25 which is coupled to an outwardly protruding portion of the outer tube 17 and is screw-coupled to a screw thread of a plate holder 23 in the state that a top surface of the outer-ring forging punch 20 is contacted with a bottom surface of the hard plate 21.

A lower press 30 is provided with a lower die 31, an inner surface 311 of which has the same shape with the exterior surface of the outer-ring 2. The lower die 31 is fixed by a lower die holder 33 and a coupling nut 35. In a center hole of the lower die 31, an ejecting pin 37 for ejecting the formed outer-ring 2 outside is coupled vertically movably.

Figure 5A:
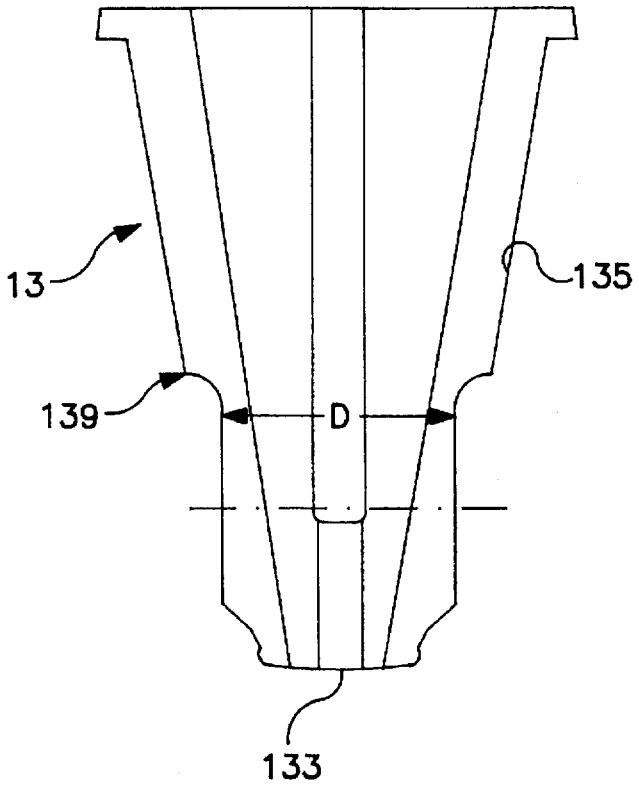
FIGS. 5(A) and 5(B) are longitudinal sectional view and bottom view of a punch piece slide member of the invention.
Figure 5B:
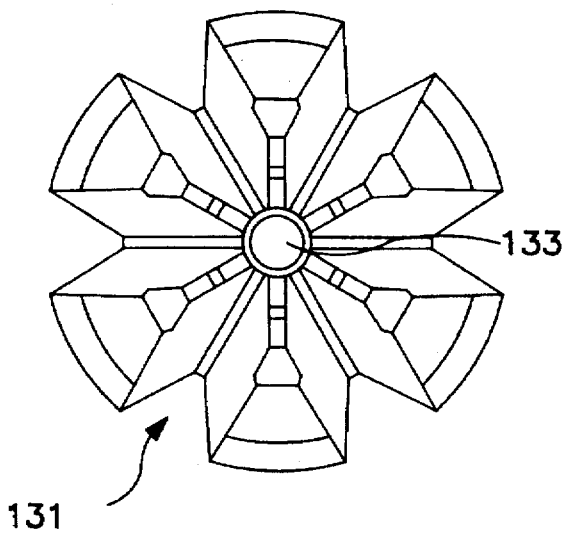
Figure 6A:
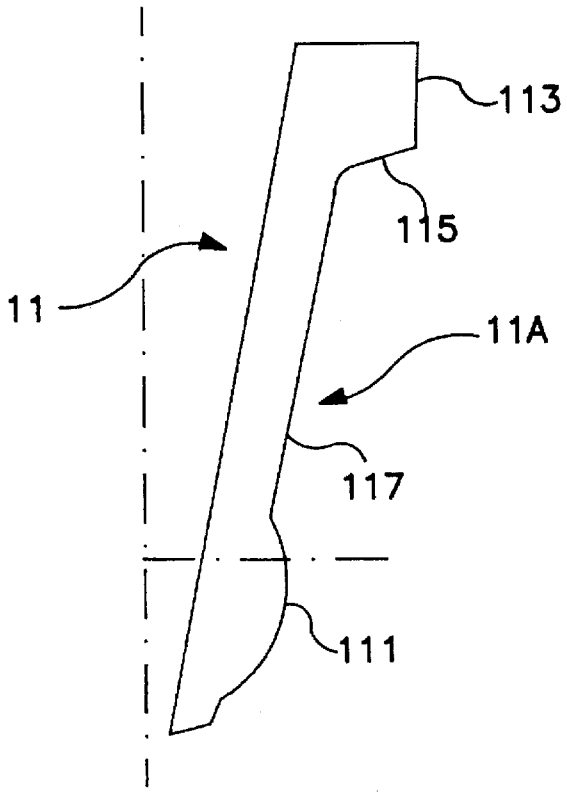
FIGS. 6(A) and 6(B) are longitudinal sectional view and bottom view of a punch piece of the invention.
Figure 6B:
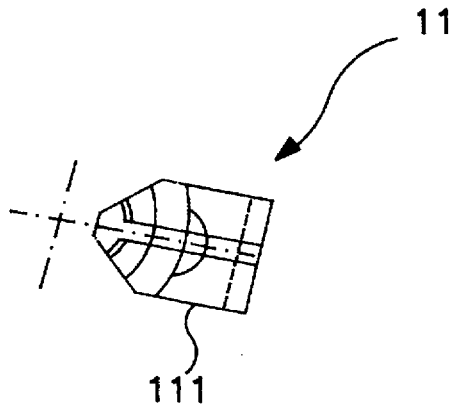

Referring to FIGS. 5A and 5B, the punch piece slide member 13 has six grooves 131, each of which is downwardly tapered and is located with equivalent space each other. In addition, the lower portion of the slide member 13 is formed of a circular bar shape having the same diameter D along a predetermined length, and the upper portion of the slide member 13 is formed of a truncated cone shape having an upwardly increasing diameter via a step portion 139.

Figure 4:
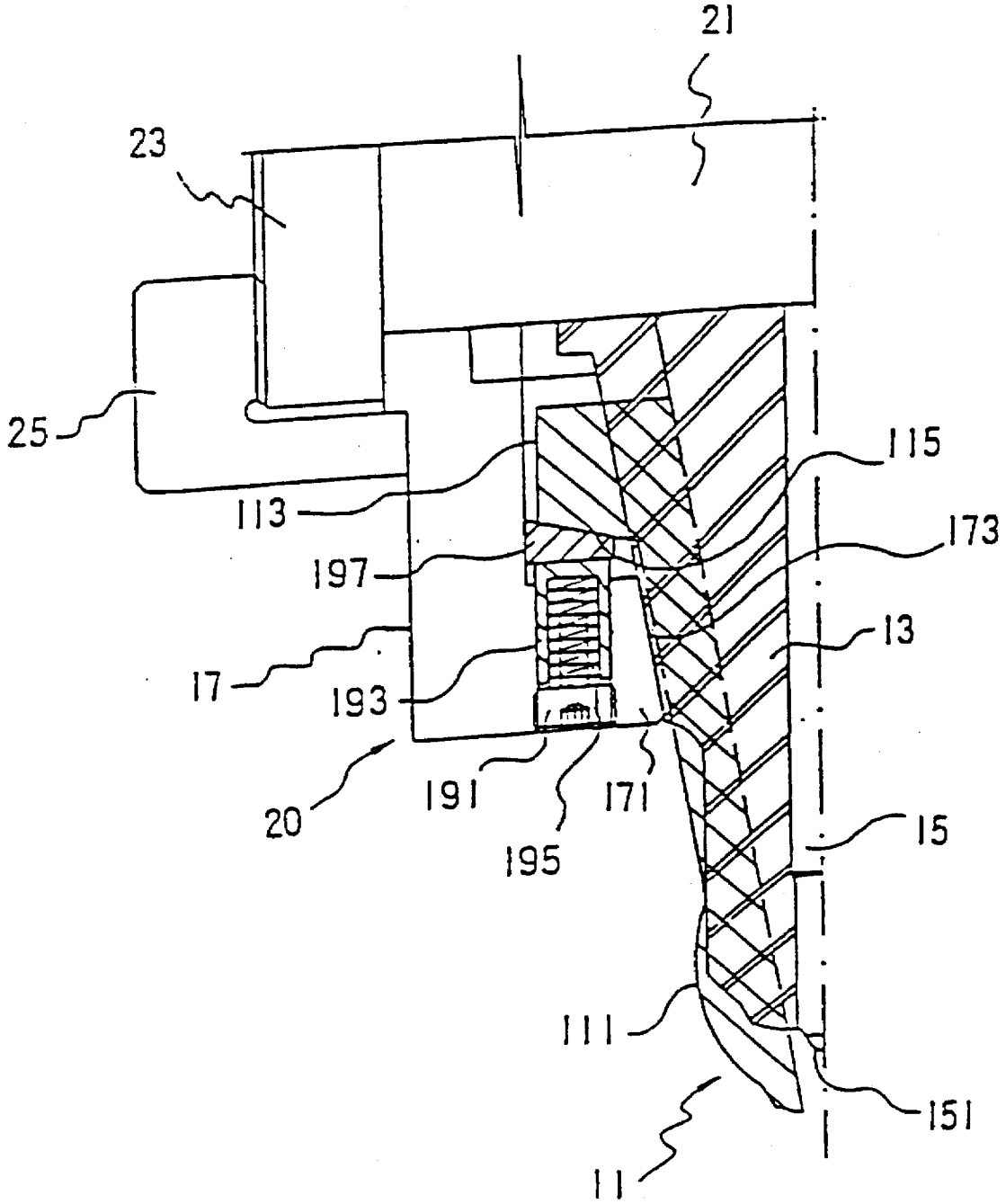
FIG. 4 is an enlarged cross-sectional view showing a sliding operation of the punch piece when an upper press moves up.

Referring to FIG. 4, a front end surface 173 of the inwardly extending portion 171 is slanted equally to a slant of the tapered grooves 131 and an exterior surface 135 of the punch piece slide member 13.

The six resilient member assemblies 19 are formed in the inwardly extending portion 171 of the outer tube 17 corresponding to each of the six punch pieces 11.

Each of the six resilient member assemblies 19 comprises a bolt 191 which is screw-coupled to the through-hole formed in the inwardly extending portion 171, a housing 193 which may be inserted into the through-hole, and a resilient spring 195 inserted into the housing 193. On the housing 193, there is provided a supporting portion 197 which is made of copper and has a slant equal to that of bottom surface 115 of the angled protrusion 113 of the punch piece 11.

The operation of the outer-ring forging punch will be described with reference to FIG. 3 as follows.

Figure 7A:
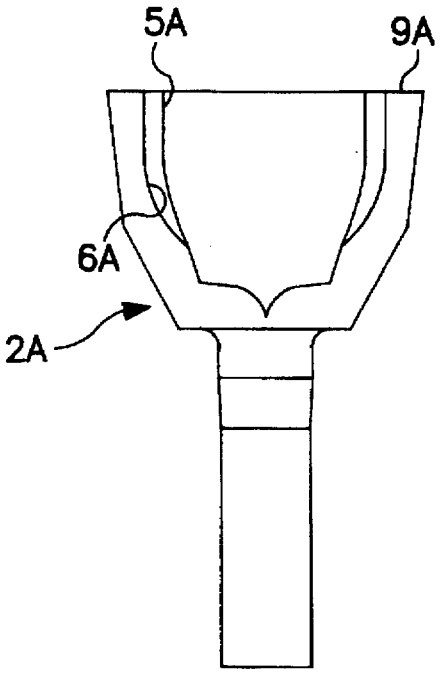
FIGS. 7(A) and 7(B) are cross-sectional views of unfinished outer-ring and finished outer-ring using an outer-ring forging punch in accordance with the first embodiment.
Figure 7B:
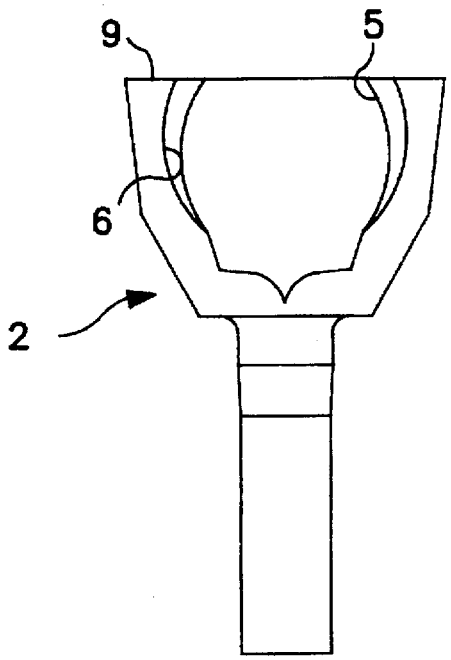

As shown in FIG. 7(A), there is prepared a pre-processed outer-ring 2A in which its spherical inner surface 5A and curved ball track grooves 6A expand as straight from maximum diameter portion to apature end by pre-process step.

Figure 3:
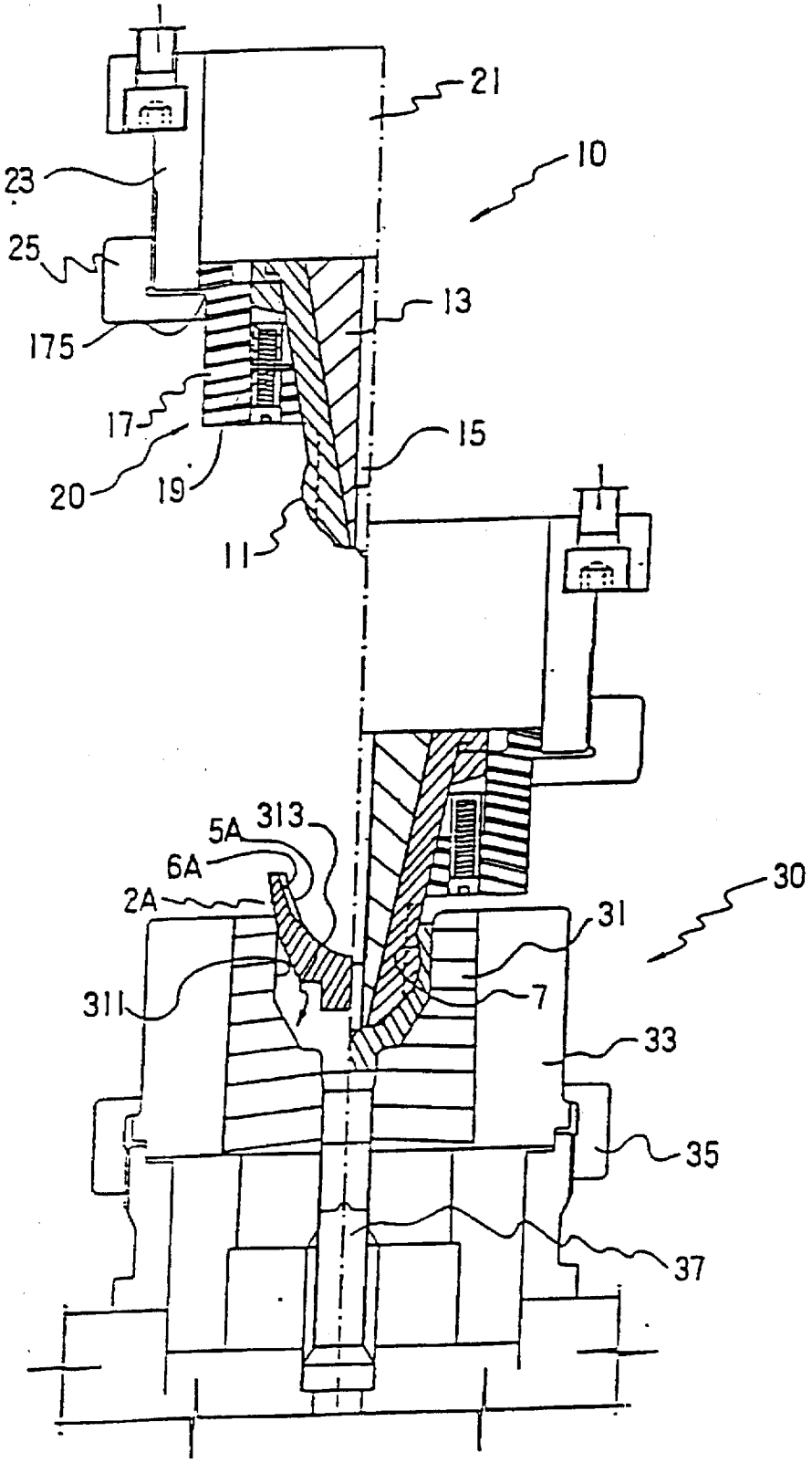
FIG. 3 is a cross-sectional view explaining an operation of forge-forming an outer-ring of the constant velocity joint using an outer-ring forging punch in accordance with a first embodiment of the invention.

Then, in the state that the pre-processed outer-ring 2A is set in a groove 313 of the lower die 31 as shown in left bottom of FIG. 3, the upper press 10 moves down vertically.

In accordance with a downward movement of the upper press 10, the lower head of the outer-ring forging punch 20 pushes the pre-processed outer-ring 2A down into the groove 313 of the lower die 31 so that the upper periphery 9A of the outer-ring 2A is contracted to enclose the head of the outer-ring forging punch 20.

Subsequently, the outer-ring forging punch 20 moves down up to a position shown in right of FIG. 3, the bottom of the pre-processed outer-ring 2A is pressed and thus, the periphery 9A of the outer-ring 2A encloses the punch pieces 11 and the punch piece slide member 13, so that the peripheral surface 9 of the outer-ring 2A is forged as a shape equal to that of the inner surface 311 of the lower die 31 and the inner surface 5 of the outer-ring 2A is forged as a shape equal to that of the head of the outer-ring forging punch 20. Namely, the inner surface 5 of the forged outer-ring 2 is formed of the spherical shape corresponding to the head of assembly of the punch piece slide member 13 and the punch pieces 11 and further, in the inner surface 5, the ball track grooves 3 corresponding to the protrusions 111 of the punch pieces 11 are formed with equal space.

After completion of forge-forming by pressing, the upper press 10 ascends vertically. In this case, as shown in FIG. 4, the outer tube 17 and the punch piece slide member 13 of the outer-ring forging punch 20 ascend according to the ascent of the upper press 10, but six punch pieces 11 maintain the state of engaging with the upper periphery 9 of the forged outer-ring 2.

According to further ascent of the outer-ring forging punch 20, the resilient springs 195 within the outer tube 17 are compressed and at the same time, the upper portions of the punch pieces slides along the tapered grooves 131 of the punch piece slide member 13. Therefore, the upper portions of the punch pieces 11 are gathered closely each other and the lower ends of the punch pieces 11 are also gathered toward a space which is formed according to the ascent of the slide member 13.

Accordingly, when the outer diameter of the protrusions 11 of the punch pieces is smaller than that of the apature of outer-ring 2, the punch pieces 11 are separated from the outer-ring 2 and at the same time, returns to an original position of the outer tube 17 by means of a restoring force of the compressed resilient springs 195. Then, the ejecting pin 37 ascends and pushes up the finished outer-ring 2 outside of the lower die 31.

According to the embodiment described above, after the forge-forming is completed by pressing step of only the outer-ring forging punch 20, the outer-ring forging punch 20 slips out of the inner periphery of the finished outer-ring 2 by contraction and restoration action. Therefore, it is possible to simplify a structure of the outer-ring forging punch 20 and the lower die 31.

According to this embodiment, since resilient member assemblies 19 are mounted at the inwardly extending portion 171 of the outer tube 17, it enables the outer-ring forging punch 20 to be constructed simply and shortly, so that it is possible to shorten the length of the punch pieces 11, thereby to improve the durability of the general outer-ring forging punch 20.

Further, the inwardly extending portion 171 of the outer tube 17 functions as sliding guide of the punch pieces 11 in cooperation with the punch piece slide member 13, so that roaming of the punch pieces 11 is prevented during the sliding of the punch pieces.

Figure 8:
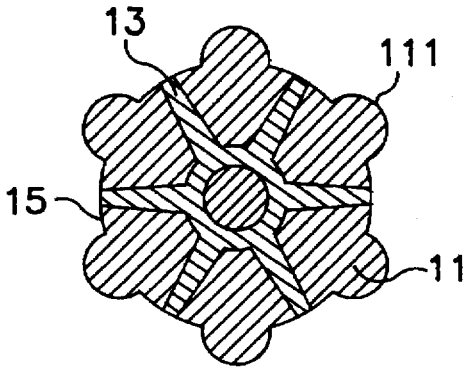
FIG. 8 is a cross-sectional view of a head portion of the outer-ring forging punch in accordance with the first embodiment.

In addition, since the head portion of the outer-ring forging punch 20 has no gap between the punch piece slide member 13 and the punch pieces 11 as shown in FIG. 8, the outer-ring forging punch has an effective structure in transferring the vertical force, thereby to apply bigger pressing force as compared with the prior art forge-forming punch. Therefore, reliability with respect to contraction and restoration of the punch pieces is improved, so it is possible to obtain the finished outer-ring in which the inner surface and the ball track grooves are formed very precisely.

FIGS. 9 to 12 show an outer-ring forging punch in accordance with a second embodiment of the invention.

Figure 9:
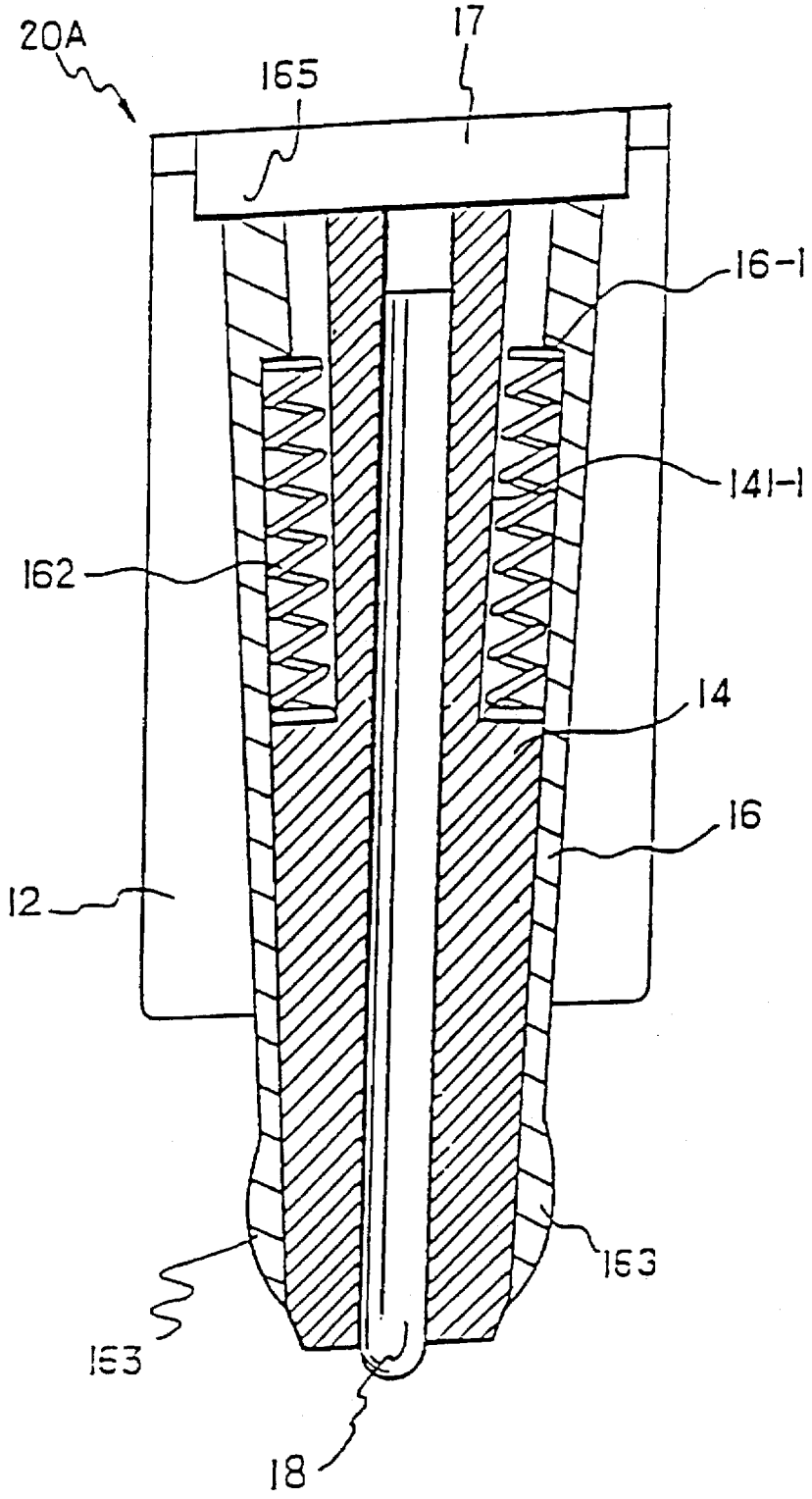
FIG. 9 is a longitudinal sectional view of an outer-ring forging punch in accordance with a second embodiment of the invention.
Figure 10:
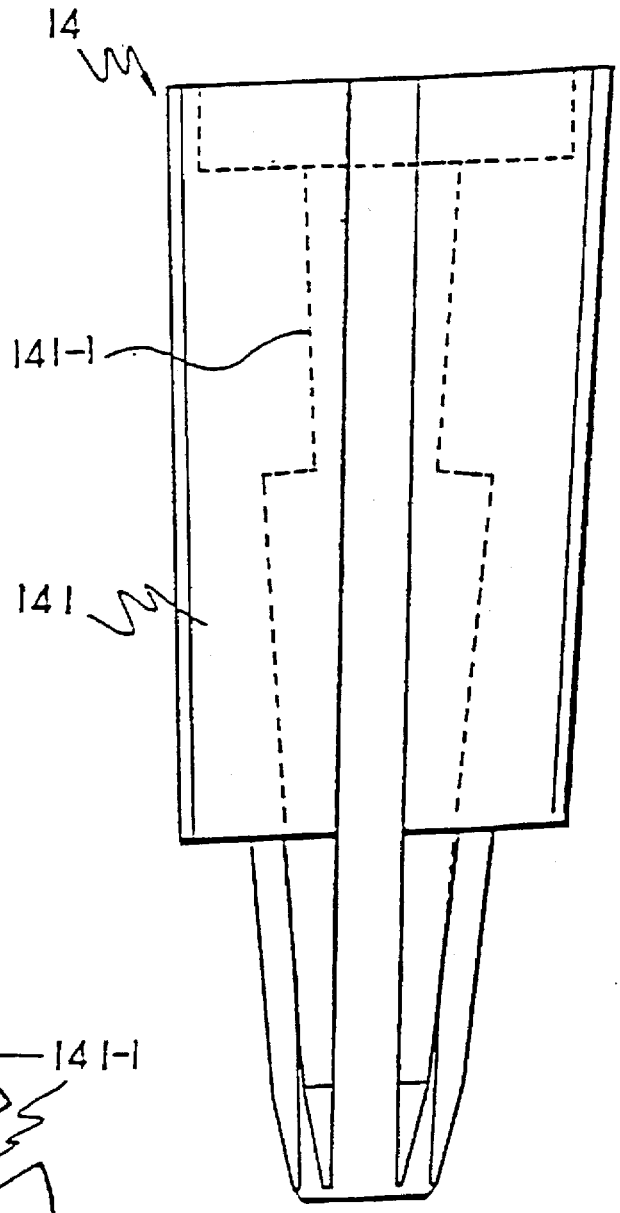
FIG. 10 is a side view of a punch piece slide member shown in FIG. 9.
Figure 11:
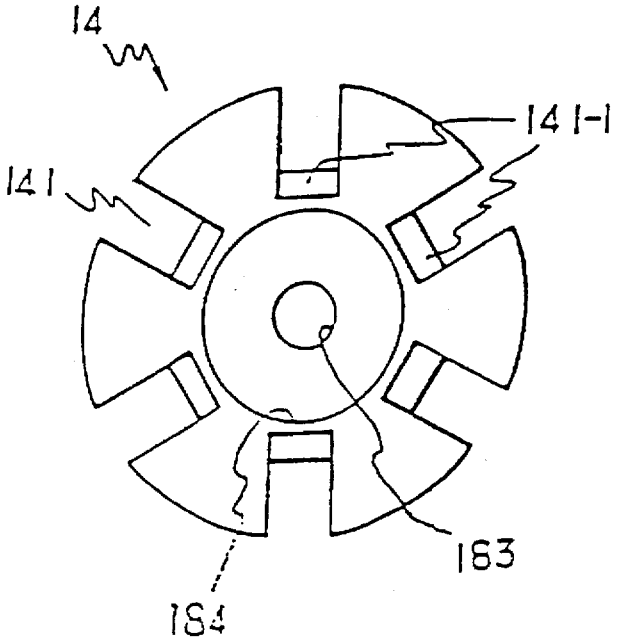
FIG. 11 is a plane view of FIG. 10.

FIG. 9 is a longitudinal sectional view of the outer-ring forging punch, FIG. 10 is a side view of a punch piece slide merber and FIG. 11 is a plane view of FIG. 10.

Referring to FIG. 9, the forge-forming punch 20A comprises a stem 18 having a spherical protrusion at a lower end, six punch pieces 16 each having a protrusion 163 corresponding to a ball track groove 3 of the outer-ring 2, a punch piece slide member 14 in which the punch pieces 16 are slidably coupled to grooves 141, and an outer tbe 12 surrounding the above parts.

Figure 12:
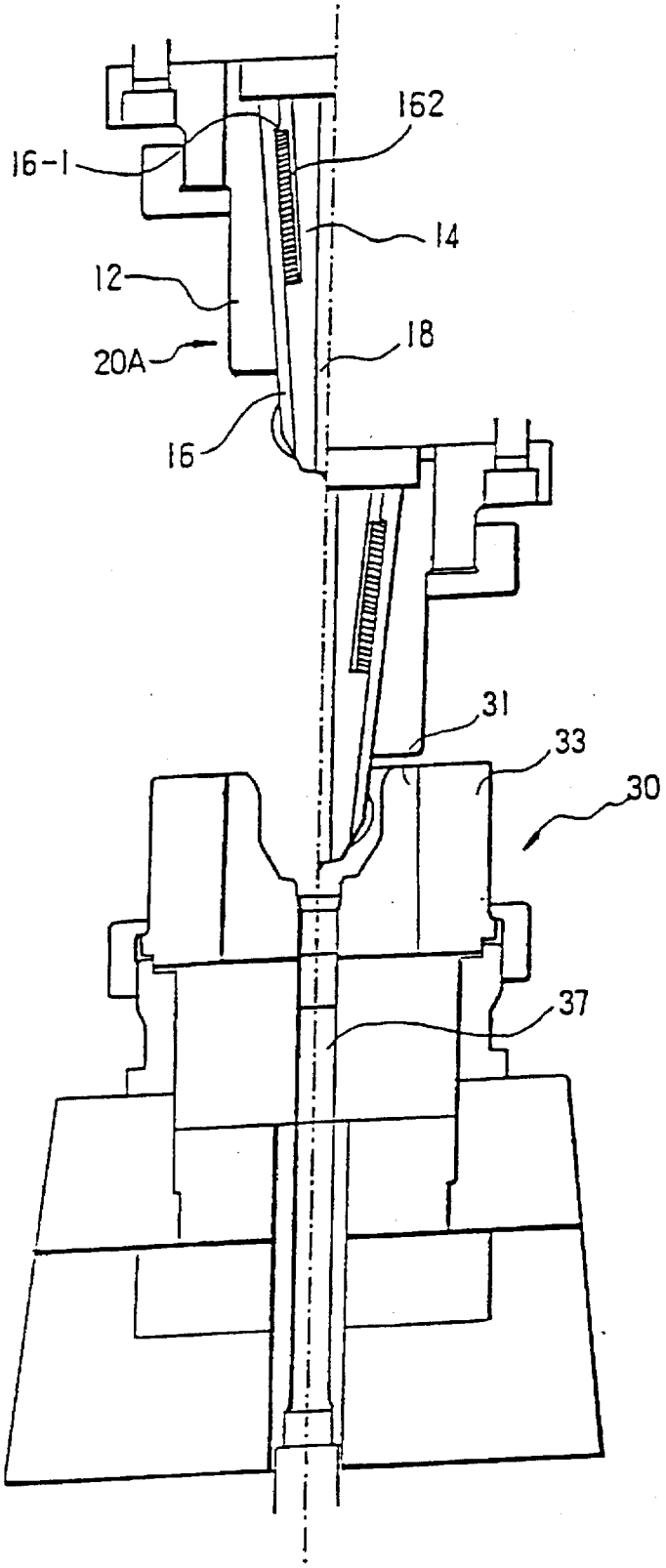
FIG. 12 is a cross-sectional view explaining an operation of forge-forming the outer-ring using an outer-ring forging punch in accordance with the second embodiment.

In an upper portion of the groove 141 of the punch piece slide member 14 is formed a deep groove 141-1 in which a resilient spring 162 may be accomodated and in an inward and upper portion of the punch piece 16, a protruding jaw 16-1 for supporting the spring is formed. The spring 162 is inserted between the groove 141-1 and protruding jaw 16-1, the punch piece 16 is always located at the upper side of the punch piece slide member 14. The above outer-ring forging punch 20A is mounted to an upper press to forge-form the outer-ring as shown in FIG. 12.

The operation of forge-forming the outer-ring will now be described with reference to FIG. 12.

The operation of forge-forming the outer ring by means of the second embodiment is substantially the same as that by means of the above first embodiment.

Namely, in the state that the pre-processed outer-ring 2A is set in a groove of the lower die 31, the upper press moves down vertically.

In accordance with a downward movement of the upper press, the lower head of the outer-ring forging punch 20A pushes the pre-processed outer-ring 2A down into the groove of the lower die 31 so that the upper periphery 9A of the outer-ring 2A is contracted to enclose the head of the outer-ring forging punch 20A.

Subsequently, the outer-ring forging punch 20A moves down up to a position shown in right of FIG. 12, the bottom of the pre-processed outer-ring 2A is pressed and thus, the periphery 9A of the outer-ring 2A encloses the punch pieces 16 and the punch piece slide member 14, so that peripheral surface 9 of the outer-ring 2A is forged as a shape equal to that of the inner surface of the lower die 31 and the inner surface 5A of the outer-ring 2A is forged as a shape equal to that of the head of the outer-ring forging punch 20A. Namely, the inner surface 5 of the forged outer-ring 2 is formed of the spherical shape corresponding to the head of assembly of the punch piece slide member 14 and the punch pieces 16 and further, in the inner surface 5, the ball track grooves 3 corresponding to the protrusions 163 of the punch pieces 16 are formed with equal spaces.

After completion of forge-forming by pressing, the upper press ascends vertically. In this case, the outer tube 12 and punch piece slide member 14 of the outer-ring forging punch 20A ascend according to the ascent of the upper press, but six punch pieces 16 maintain the state of engaging with the upper periphery 9 of the forged outer-ring 2.

According to further ascent of the outer-ring forging punch 20A, the resilient springs 162 within the outer tube 12 are compressed and at the same time, the upper portions of the punch pieces slide along the tapered grooves 141 of the punch piece slide member 14. Therefore, the upper portions of the punch pieces 16 are gathered closely to each other and the lower end of the punch pieces 16 are also gathered toward a space which is formed according to the ascent of the slide member 14.

Accodingly, when the outer diameter of the protrusions 163 of the punch pieces 16 is smaller than that of the apature of outer-ring 2, the punch pieces 16 are separated from the outer-ring 2 and at the same time, returns to an original position of the outer tube 12 by means of a restoring force of the compressed resilient springs 162. Then, the ejecting pin 37 ascends and pushes up the finished outer-ring 2 outside of the lower die 31.

According to the second embodiment described above, after the forge-forming is completed by pressing step of only the outer-ring forging punch 20A, the outer-ring forging punch 20A slips out of the inner periphery of the finished outer-ring 2 by contraction and restoration action. Therefore, it is possible to simplify a structure of the outer-ring forging punch 20A and the lower die 31.

According to this embodiment, since resilient springs 162 are inserted between the grooves 141-1 and protruding jaws 16-1, it enables the outer-ring forging punch 20A to be constructed simply and shortly, so that it is possible to shorten the length of the punch pieces 16, thereby to improve the durability of the general outer-ring forging punch 20A.

Further, the inner tapered portion of the outer tube 12 functions as sliding guide of the punch piece 16 in cooperation with the punch piece slide member 14, so that roaming of the punch pieces 16 is prevented during the sliding of the punch pieces.

Figure 19:
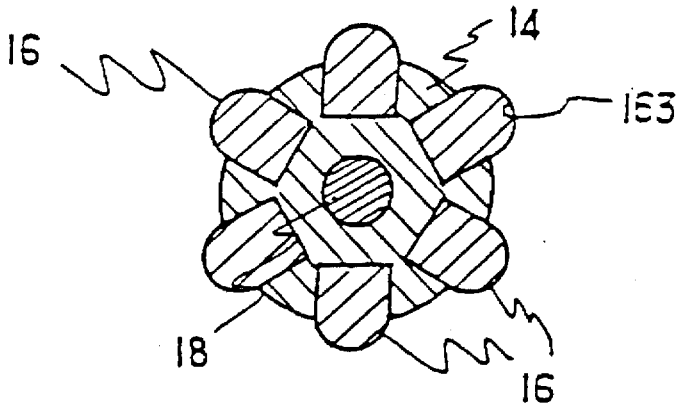
FIG. 19 is a cross-sectional view of a head portion of the outer-ring forging punch as shown in FIGS. 9 and 13.

In addition, since the head portion of the outer-ring forging punch 20A has no gap between the punch piece slide member 14 and the punch pieces 16 as shown in FIG. 19, the outer-ring forging punch has an effective structure in transferring the vertical force, thereby to apply bigger pressing force as compared with the prior art forge-forming punch. Therefore, reliability with respect to contraction and restoration of the punch pieces is improved, so it is possible to obtain the finished outer-ring in which the inner surface and the ball track grooves are formed very precisely.

FIGS. 13 to 19 show an outer-ring forging punch in accordance with a third embodiment of the invention.

Figure 13:
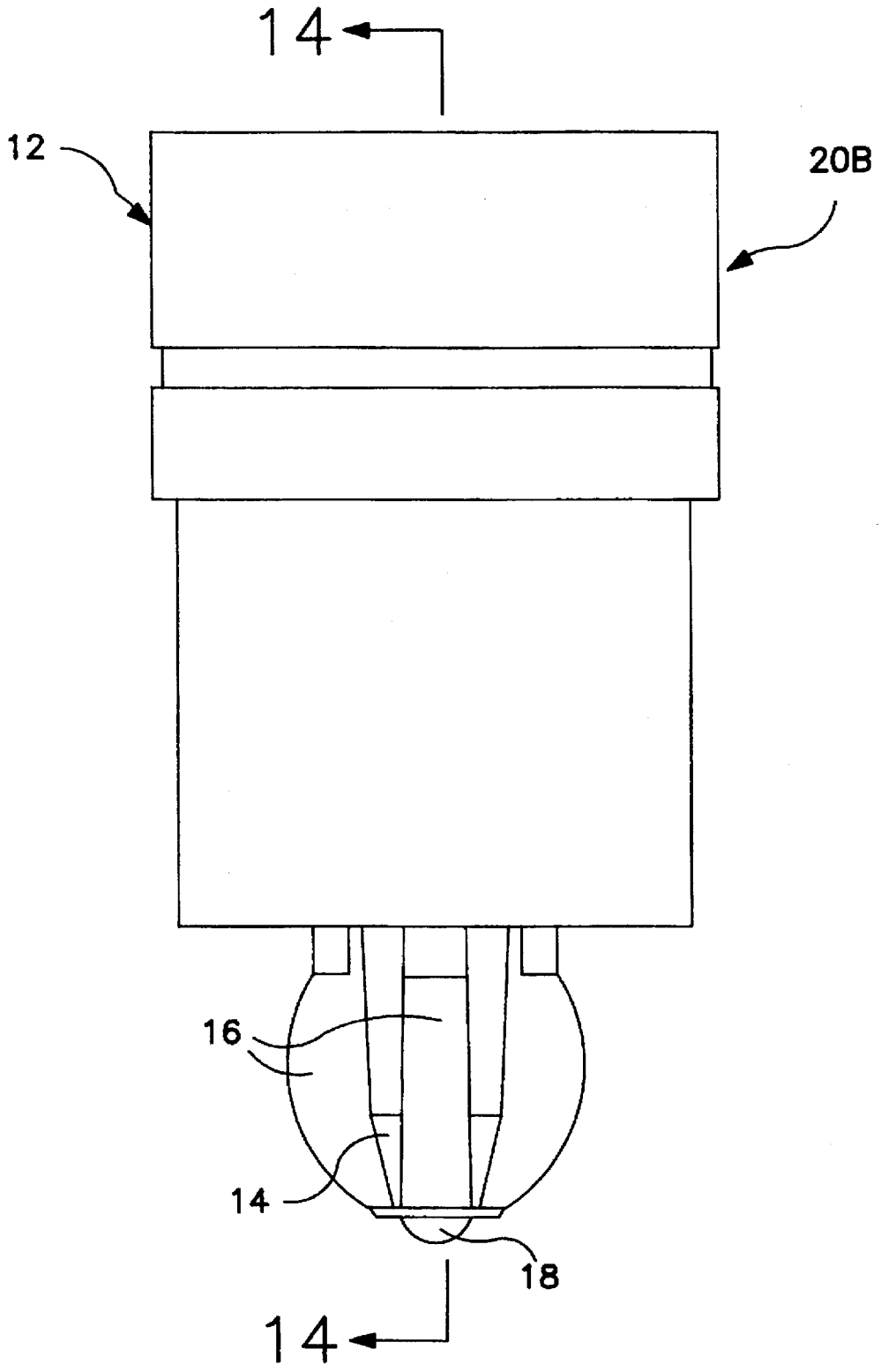
FIG. 13 is a front view of an outer-ring forging punch in accordance with a third embodiment of the invention.
Figure 14:
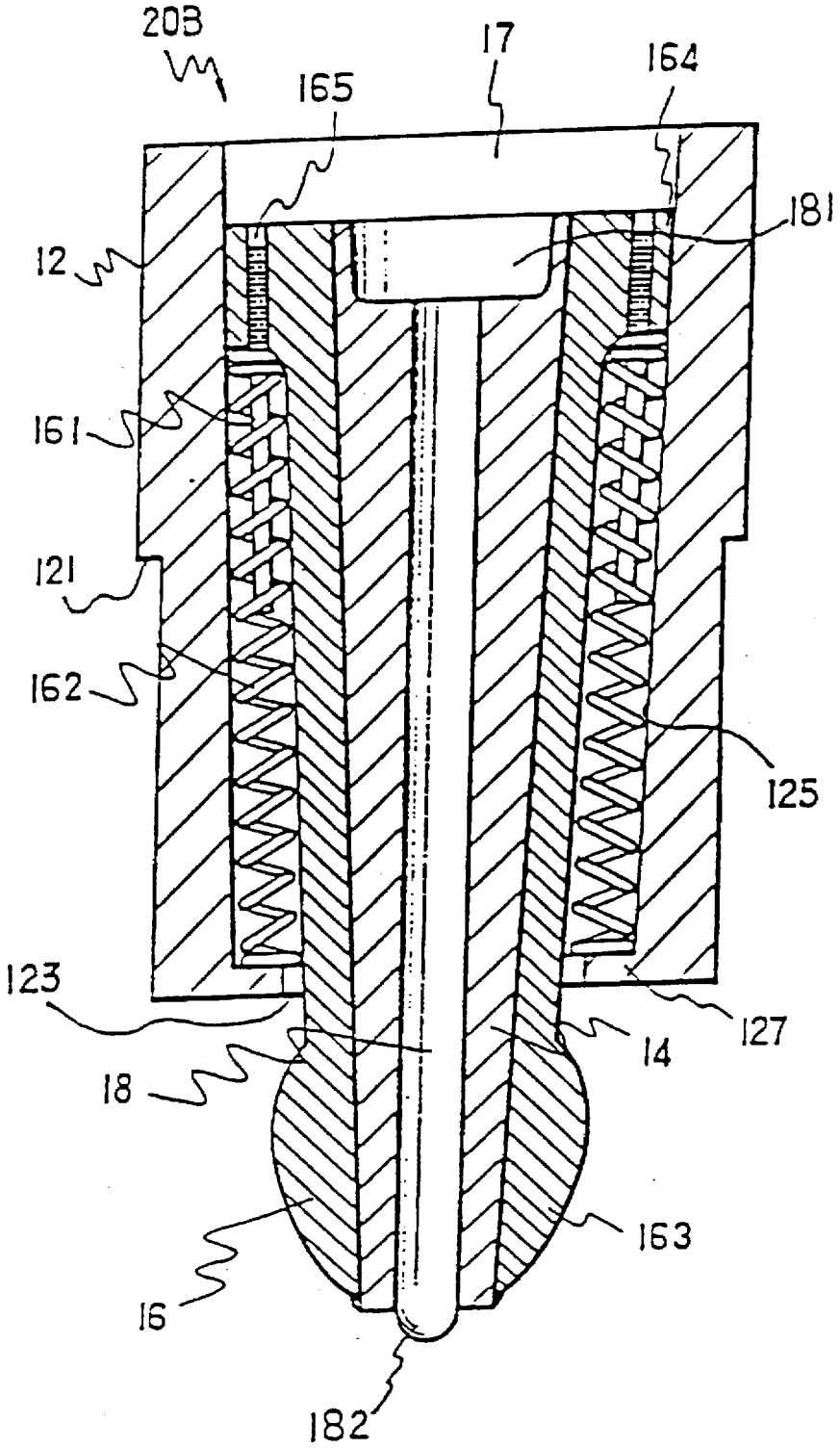
FIG. 14 is a cross-sectional view on the line A—A of FIG. 13.

FIG. 13 shown a front view of an outer-ring forging punch in accordance with a third embodiment and FIG. 14 shows a cross-sectional view on the line A—A of FIG. 13.

Figure 15:
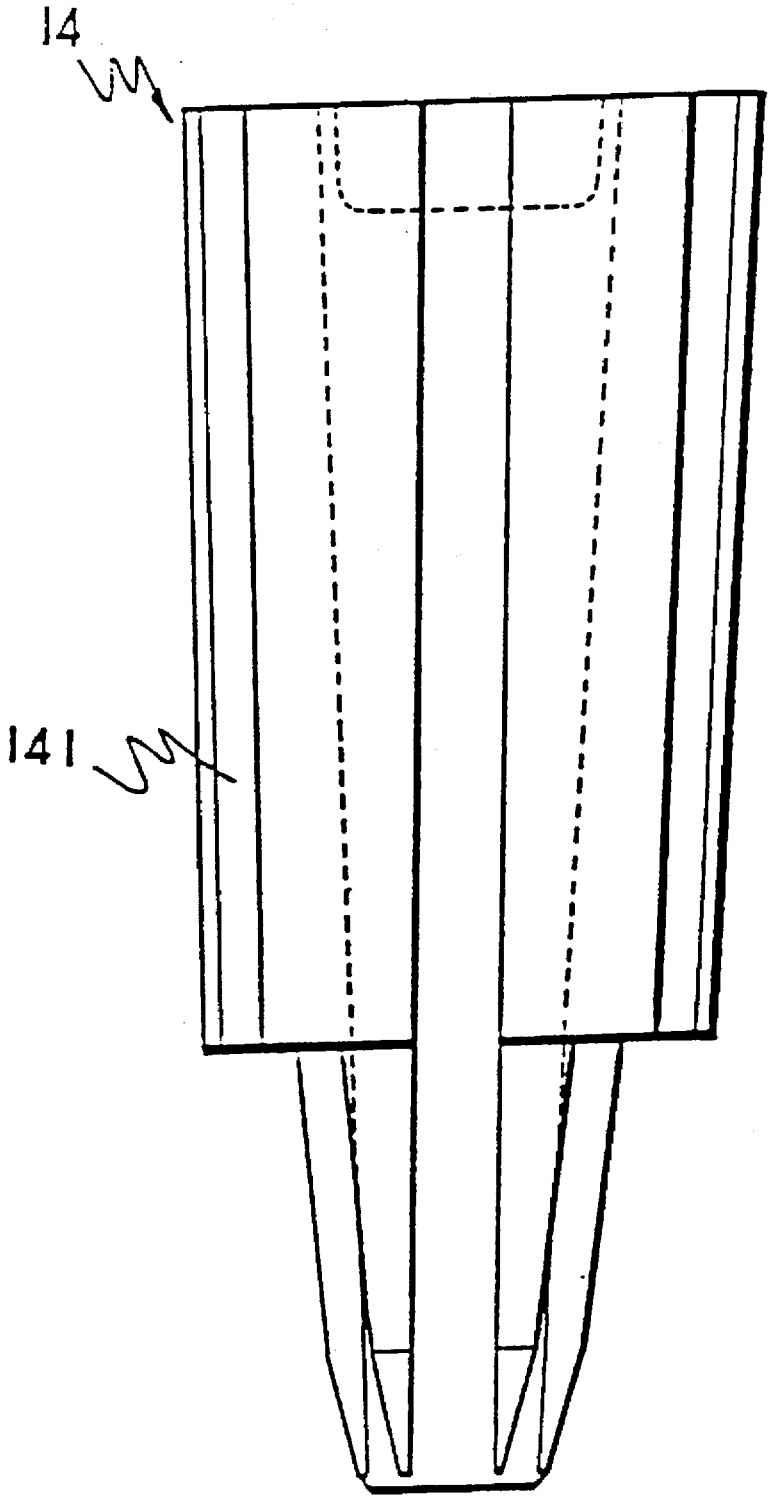
FIG. 15 is a front view of a punch piece slide member shown in FIG. 14.
Figure 16:
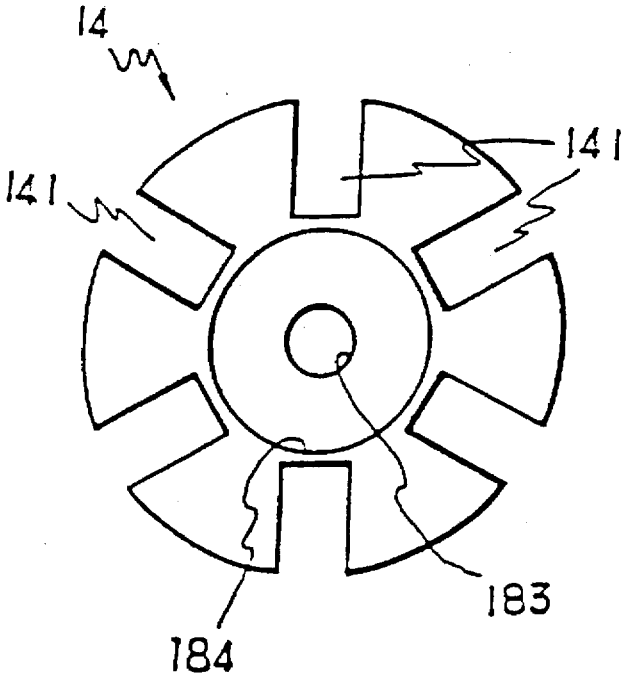
FIG. 16 is a plane view of FIG. 15.
Figure 17:
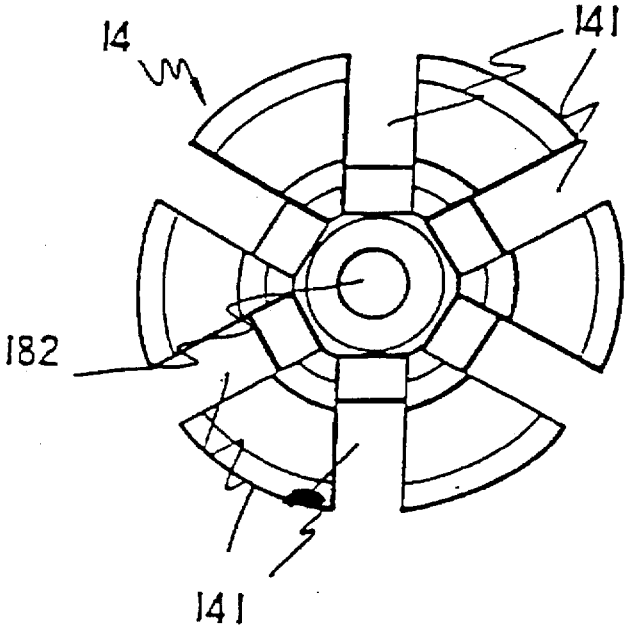
FIG. 17 is a bottom view of FIG. 15.
Figure 18:
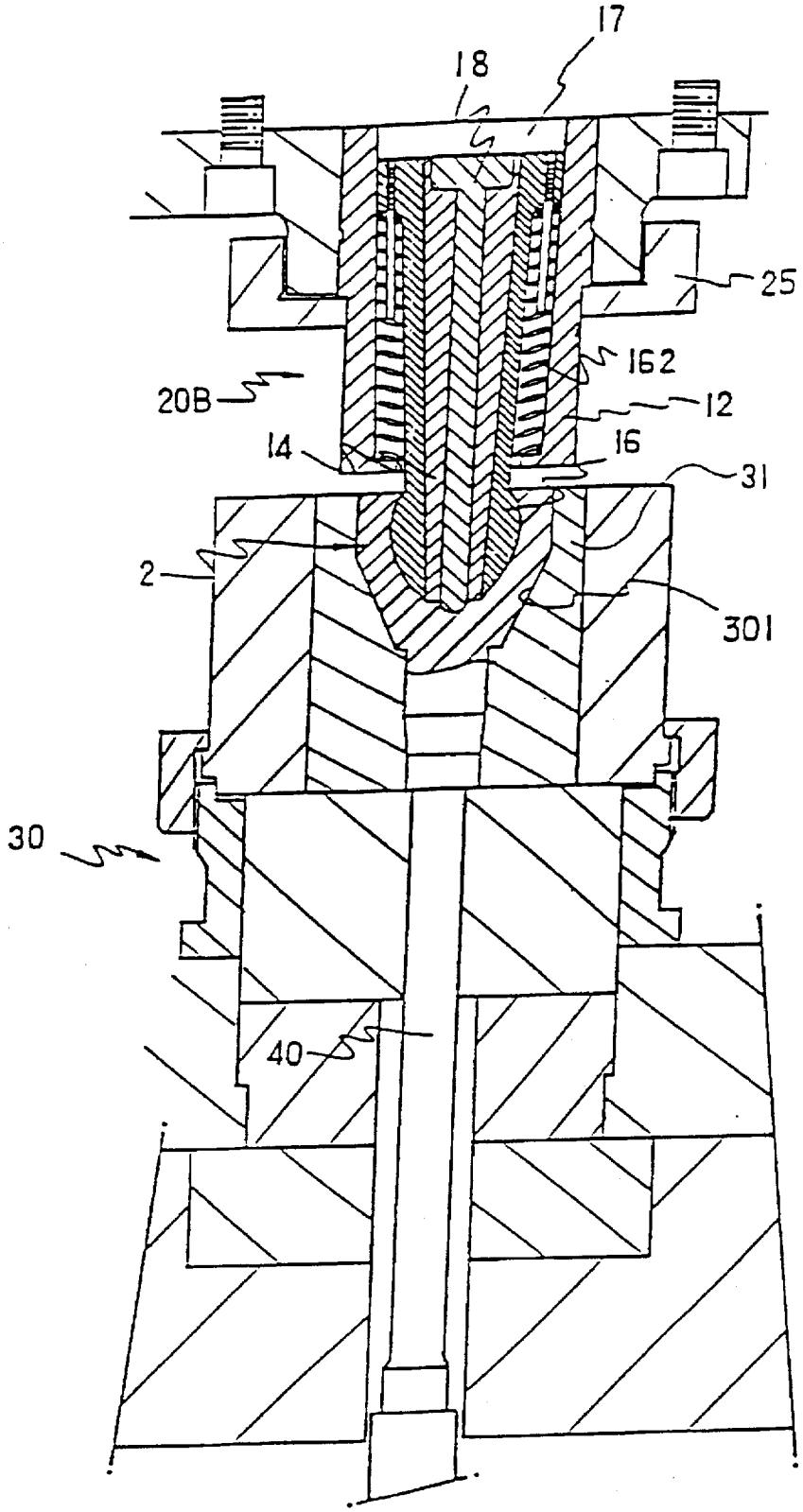
FIG. 18 is a cross-sectional view partially showing a press apparatus using an outer-ring forging punch of the third embodiment.

Refering to FIGS. 13 and 14, the outer-ring forging punch 20B comprises a stem 18 having a spherical protrusion 182 at its lower end, six punch pieces 16 each having a protrusion 163 corresponding to a ball track groove 3 of the outer-ring 2, a punch piece slide member 14 in which the punch pieces 16 are slidably coupled to grooves 141 as shown in FIGS. 15 to 17, and an outer tube 12 surrounding the above parts.

The stem 18 is coupled to the through-hole 183 at the center of the punch piece slide member 14. The spherical protrusion 182 of the stem 18 is limited by a large circular flange 181 integrally formed at the upper end (Refer to FIG. 14).

Each of the punch pieces 16 has an angled protrusion 164 at its upper end and the protrusion 163 which is, at the lower end, formed of a shape corresponding to the ball track groove of the outer-ring 2.

The engled protrusion 164 has a hole 165 to which a supporting 161 is fixed. Between the supporting rod 161 and an inwardly extending portion 127 of the outer tube 12, a resilient spring 162 is inserted.

On the punch piece slide member 14, the stem 18 and the punch piece 16, a punch plate 17 is disposed. Therefore, the punch piece 16 does not move upwardly but move downwardly.

If the punch piece 16 moves down, the punch piece 16 compresses the spring 162. Thus, at the time of retraction, the punch piece 16 returns to the original position by means of a restorating force of the compressed spring 162.

The punch piece slide member 14 has six downwardly tapered grooves 141 and a profile of reverse cone shape of the small and big diameters.

An interior of the outer tube 12 is tapered, and its exterior has a step portion 121 to which a coupling nut 25 is coupled. Further, between the interior of the outer tube 12 and tapered grooves 14, the uniform spaces are mintained and also functions as sliding guide of the punch pieces 16.

The operation of the third embodiment is substantially the same as that of the first and second embodiments, and thus its explanation of operation is omitted.

According to the third embodiment, since the respective punch pieces 16 are supported by the respective springs 162, roaming of the punch pieces is prevented. Therfore, it is possible to produce the high precise outer-ring and prevent the damage of the punch pieces.

Figure 20:
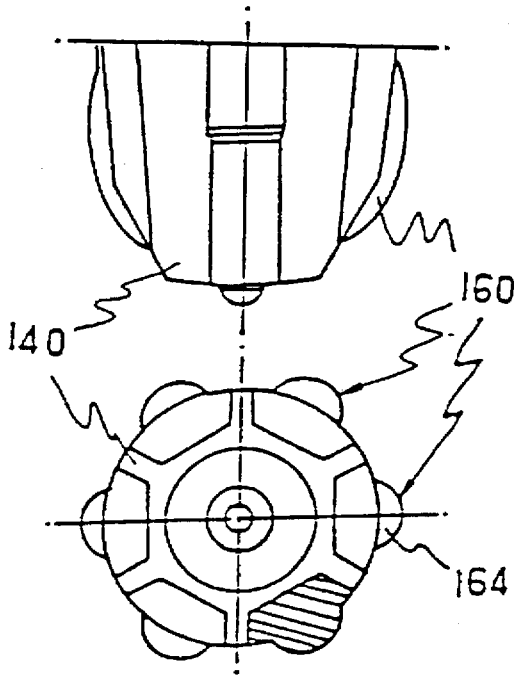
FIG. 20 is a cross-sectional view of a head portion of a punch piece assembly in accordance with another embodiment.

FIG. 20 shows a head of another embodiment of an outer-ring forging punch. Six punch pieces 160 are generally formed of spherical shape in cooperation with a slide member 140. The punch piece, further, has a protrusion 164 which is formed of a hemisphere shape corresponding to the ball trach groove 6.

The above-mentioned embodiments exemplify the cases that the stem is coupled to the central through-hole of the punch piece slide member, but this invention is not limited to this examples.

Figure 21A:
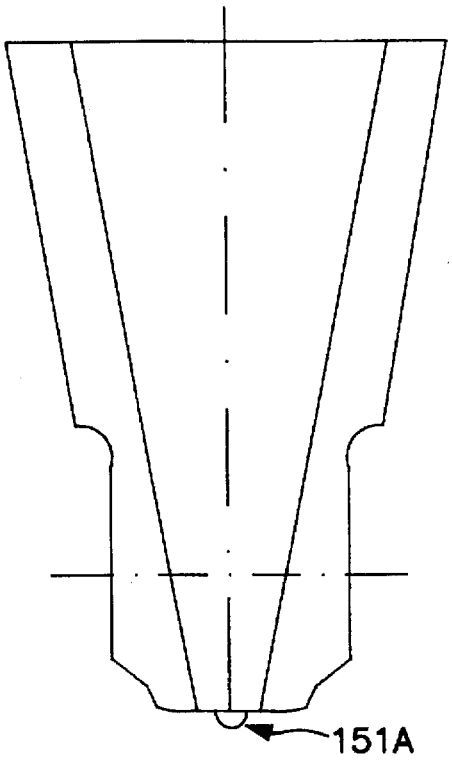
FIGS. 21(A) and (B) are a longitudinal sectional view and a bottom view of a punch piece slide member in accordance with the invention.

A punch piece slide member 13A may not include a stem as shown in FIGS. 21(A) and (B). Instead, a small hemisphere is integrally formed to the lower portion 151A of the slide member 13A. Further, sliding grooves 131A of the slide member 13A is formed of a substantially reverse triangle shape instead of rectangular shape (FIG. 19), reverse ladder shape (FIG. 20), and approximately reverse triangle shape (FIG. 8). In this case, it is possible to receive bigger force than those of the above cases.

Figure 21B:
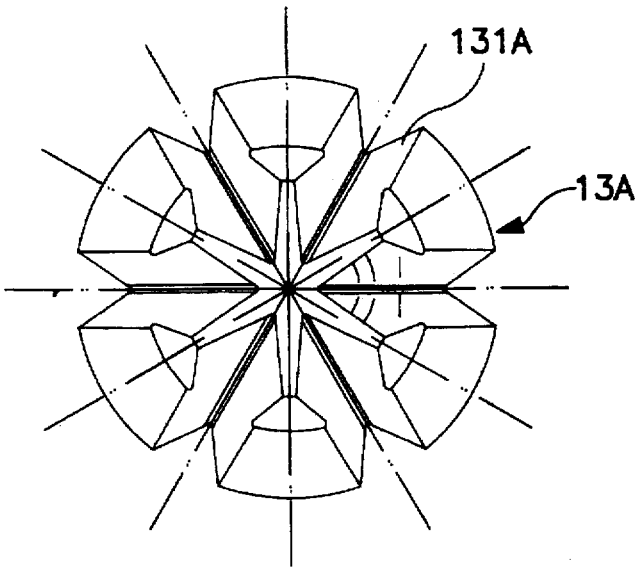
Figure 22A:
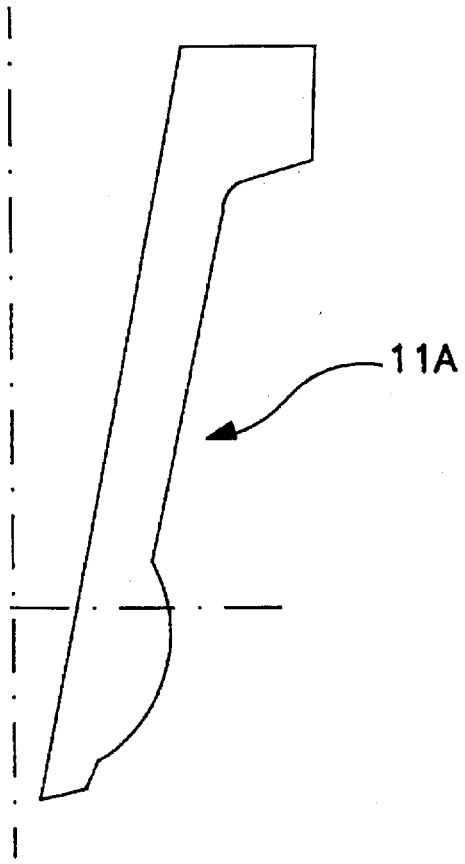
FIGS. 22(A) and (B) are a side view and a bottom view of a punch piece coupled to the slide member of FIG. 21.
Figure 22B:
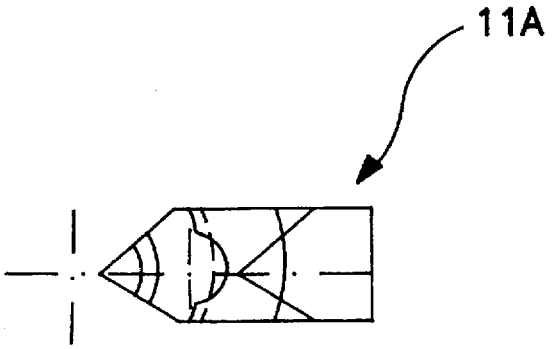

FIGS. 22(A) and (B) show a side view and a bottom view of the punch piece 11A coupled to the slide member 13A of FIG. 21, respectively.

Since such an assembly of the punch pieces 11A and the slide member 13A increases coupling force each other, damage of the punch pieces 11A is prevented and bigger force can be transferred.

In the above embodiments, the forging punch is mounted to the upper press, but reversely, the forging punch may be mounted to the lower die.

From the foreging description of the structure of this inventiog it will also be apparent to those skilled in the art that various changes other than those already described may be made in the size, shape, type, number and arrangement of parts described hereinbefore without the appended claims.

Industrial Appicability

The invention is applicable in forge-forming an outer-ring of a constant velocity joint.

I claim:

1. An outer-ring forge-forming apparatus of a constant velocity joint having a spherical inner surface 5 and a plurality of curved ball track grooves 6 comprising:

a plurality of punch pieces 11, each having a protrusion 111 which is, at the lower portion, formed of a hemisphere shape corresponding to the curved ball track groove 6, and an angled protrusion 113 at its upper end;

a punch piece slide member 13 having a plurality of downwardly tapered grooves 131 in which said plurality of punch pieces 11 are coupled slidably, and an exterior surface 135;

an outer tube 17 having, at its lower end, an inwardly extending portion 171 which supports said punch piece slide member 13 and forms a sliding guide in cooperation with said tapered grooves 131 of the punch piece slide member 13, said inwardly extending portion 171 having a front end surface 173 slanted equally to a slant of the tapered grooves 131 and said exterior surface 135 of the punch piece slide member 13;

a plurality of resilient member assemblies 19 formed in the inwardly extending portion 171 for supporting resiliently said plurality of punch pieces 11;

a lower die 31 having an inner surface of the same shape as an exterior surface 9 of the outer-ring wherein a lower portion of the slide member 13 has a circular bar shape with a constant diameter along a predetermined length and an upper portion of the slide member 13 has a truncated cone shape with an upwardly increasing diameter via a step portion 139;

an assembly of the slide member 13 and punch pieces 11 has no gap between the slide member 13 and the punch pieces 11.

2. An outer-ring forge-forming apparatus according to claim 1, wherein said each of plurality of resilient member assemblies comprises;

a bolt 191 which is screw-coupled to a through-hole formed in the inwardly extending portion 171;

a housing 193 which can be inserted into the through-hole; and a resilient spring 195 inserted into the housing 193.

3. An outer-ring forge-forming apparatus according to claim 1, wherein said each tapered groove 131 is formed of reverse triangle shape, and a cross section of said each punch piece 11 is formed of reverse triangle shape correspon- ding to said tapered groove 131.

4. An outer-ring forging punch of a constant velocity joint comprising:

a plurality of punch pieces 16, each having a hemisphere-shape protrusion 163 at the lower portion and an inward protrusion 16-1 at the upper portion;

a punch piece slide member 14 having a plurality of downwardly tapered grooves 141, said each tapered groove 141 having a deep groove 141-1 corresponding to the inward protrusion 16-1;

a plurality of resilient member 162, each inserted between the deep groove 141-1 and the inward protrusion 16-1 for urging the punch pieces 16 in the upward direction;

a stem 18 coupled to a through-hole of the slide member 14 and having a spherical protrusion at it slower end; and an outer tube 12 for accommodating and supporting the slide member 14 in which the punch pieces 16 and the stem 18 are coupled and guiding sliding of the punch pieces 16 in an up and down movement;

a punch piece slide member 14 having a plurality of downwardly tapered grooves 141 in which a plurality of punch pieces 16, 160 are coupled slidably;

wherein said each groove 141 of the slide member 14 has a rectangular-shape;

three surfaces of each punch piece 160 are buried in each groove 141 and a protrusion 163 of each punch piece is exposed; and said each groove 141 of the slide member 14 is formed of reverse ladder-shape, three surfaces of each punch piece 160 are buried in each groove, an outer surface of each punch piece 160 is formed of spherical shape together with an outer surface of the slide member 140, and the protrusion 163 is disposed in the center of the outer surface of each punch piece 160.

5. An outer-ring forging punch of a constant velocity joint comprising:

a plurality of punch pieces 16, 160 each having a protrusion 163 which is, at the lower portion, formed of a hemisphere shape corresponding to a ball track groove 6 of the outer-ring and an angled protrusion 164 at its upper end;

a punch piece slide member 14 having a plurality of downwardly tapered grooves 141 in which a plurality of punch pieces 16, 160 are coupled slidably;

a stem 18 coupled to a central through-hole 183 of the slide member 14 and having a spherical protrusion 182 at its lower end;

an outer tube 12 for accommodating and supporting the slide member 14 in which the punch pieces 16 and the stem 18 are coupled, and guiding the punch pieces in cooperation with the slide member 14; and means 162 inserted between the angled protrusion 162 of the punch pieces and the outer tube 12 for returning the punch pieces;

wherein said each groove 141 of the slide member 14 has a rectangular-shape;

three surfaces of each punch piece 16 are buried in each groove 141 and the hemisphere surface 163 of the punch piece is exposed; and said each groove 141 of the slide member 14 is formed of reverse ladder-shape, three surfaces of each punch piece 160 are buried in each groove, an outer surface of each punch piece 160 is formed of spherical shape together with an outer surface of the slide member 140, and the protrusion 163 is disposed in the center of the outer surface of each punch piece 160.

6. A method for forge-forming an outer-ring of a constant velocity joint having a spherical inner surface 5 and a plurality of curved ball track grooves 6, comprising the steps of:

preparing a pre-processed outer-ring 2A in which its spherical inner surface 5A and curved ball track grooves 6A expand as straight from a maximum diameter portion to an apature end; setting the pre-processed outer-ring 2A in a groove 313 of a lower die 31;

pressing an inner surface of the pre-processed outer-ring 2A by using a forging punch 20 in which a plurality of punch pieces 11 each having a protrusion 111 corresponding to the ball track groove 6 are slidably coupled to a plurality of downwardly tapered grooves 131 of a punch piece slide member 13, so that an upper periphery 9A of the pre-processed outer-ring 2A is contracted in line with a head shape of the forging punch 20;

vertically ascending the forging punch 20 so that said plurality of punch pieces 1 slides along the tapered grooves 131 of the slide member 13 until the lower portions of the punch pieces are separated from the inner surface of the forged outer-ring 2; and returning said plurality of punch pieces 11 separated from the forged outer-ring by means of a restorating force of a plurality of corresponding resilient member 19 in accordance with further ascent of the forging punch 20;

wherein after the punch pieces are separated from the forged outer-ring 2 according to contraction of the lower portions of the punch pieces, said method further comprising the step of:

ejecting the forge outer-ring outside of the lower die;

wherein the head of the forging punch 20 formed by the punch pieces and the slide member is formed of a continued surface corresponding to the spherical surface 5 and the ball track grooves 6 of the outer-ring 2 at the time of pressing the spherical inner surface 5A of the pre-processed outer-ring 2A.

* * * * *